US009915488B2

(12) United States Patent
Valdez et al.

(10) Patent No.: US 9,915,488 B2
(45) Date of Patent: Mar. 13, 2018

(54) THUMB MOUNTED AMMUNITION LOADER

(71) Applicants: Henry Daniel Valdez, San Lorenzo, CA (US); Joanne Maynard, Modesto, CA (US)

(72) Inventors: Henry Daniel Valdez, San Lorenzo, CA (US); Joanne Maynard, Modesto, CA (US)

( * ) Notice: Subject to any disclaimer, the term of this patent is extended or adjusted under 35 U.S.C. 154(b) by 0 days.

(21) Appl. No.: 15/476,623

(22) Filed: Mar. 31, 2017

(65) Prior Publication Data

US 2017/0284753 A1 Oct. 5, 2017

Related U.S. Application Data

(60) Provisional application No. 62/315,922, filed on Mar. 31, 2016.

(51) Int. Cl.
*F41A 9/83* (2006.01)
*A41D 13/08* (2006.01)

(52) U.S. Cl.
CPC ..... *F41A 9/83* (2013.01); *A41D 13/087* (2013.01); *A41D 2400/80* (2013.01)

(58) Field of Classification Search
USPC ..... 42/87
See application file for complete search history.

(56) References Cited

U.S. PATENT DOCUMENTS 617,929 A * 1/1899 Fowble ..... A41D 13/087 2/21
932,901 A * 8/1909 Ramsey ..... A47J 17/02 2/21
2,461,970 A * 2/1949 Finegan ..... A61F 13/105 2/21
5,963,985 A * 10/1999 Behr ..... A41D 13/087 2/161.1
6,189,254 B1 * 2/2001 Steitz ..... F41A 9/83 42/87
6,219,953 B1 * 4/2001 Bentley ..... F41A 9/83 42/90
7,487,613 B2 * 2/2009 Taylor ..... F41A 9/83 42/87

* cited by examiner

*Primary Examiner* — John W Eldred

(57) ABSTRACT

A thumb mounted ammunition loader engages a digit, preferably a thumb, of the user's hand to protect the digit while loading ammunition into a magazine. The thumb mounted ammunition loader additionally maintains traction to the pressure applied to the ammunition, as the thumb mounted ammunition loader provides a barrier to depositing skin oil onto the ammunition. The thumb mounted ammunition loader includes a digit-mounting tube, a digit-receiving opening, a distal-closed end, and at least one joint-accommodating aperture. The digit-mounting tube engages the digit. The digit-receiving opening allows the digit to be inserted into the digit-mounting tube. The distal-closed end interfaces with the ammunition as the user applies pressure to the ammunition through the distal-closed end. The at least one joint-accommodating aperture provides flexibility of the thumb mounted ammunition loader for the user to maintain range of motion of the digit.

4 Claims, 6 Drawing Sheets

THUMB MOUNTED AMMUNITION LOADER

The current application claims a priority to the U.S. Provisional Patent application Ser. No. 62/315,922 filed on Mar. 31, 2016.

FIELD OF THE INVENTION

The present invention relates generally to an apparatus for loading ammunition magazines. More specifically, the present invention is an apparatus for loading ammunition magazines that is mounted onto a user's thumb.

BACKGROUND OF THE INVENTION

Gun users typically need to load gun magazines with ammunition before the automatic or semi-automatic weapon can be operated. The magazine holds ammunition to be fed into the gun as the gun is fired. Sometimes, only a few rounds may need to be loaded into the magazine at any one time. At other times, more frequent loading of ammunition back-to-back might be required. The magazine loading process involves placing an ammunition cartridge into the magazine and using the thumb to push or propel the ammunition cartridge into a chamber. For many users, the use of the thumb to constantly nudge and push cartridges into place can cause the thumb to become tender and often slippery, making the process uncomfortable and awkward.

The present invention is an apparatus to assist with loading ammunition into a magazine. The present invention is a thumb mounted ammunition loader. The present invention fits snuggly over the thumb or other digit of the user's hand. By avoiding direct contact with the ammunition, tenderness and slipperiness associated with using the bare thumb to load is prevented. The present invention cushions the user's digit as the user forces the ammunition into the magazine. Additionally, the present invention provides a barrier to prevent skin oil being deposited onto the ammunition and causing the ammunition from becoming slippery.

DETAIL DESCRIPTIONS OF THE INVENTION

All illustrations of the drawings are for the purpose of describing selected versions of the present invention and are not intended to limit the scope of the present invention.

The present invention is a thumb mounted ammunition loader. The present invention is an apparatus that is mounted onto a digit, preferably a thumb, of a user's hand. While loading ammunition into a magazine manually without any protection, the user may experience tenderness in the digit that is forcing the ammunition into the magazine or the ammunition may become slippery due to skin oils causing the user to lose grip on the ammunition. The present invention covers the digit in order to protect the digit by cushioning the digit, as well as, provides a barrier to prevent skin oil from being deposited onto the ammunition during loading of the ammunition into a magazine.

Figure 1:
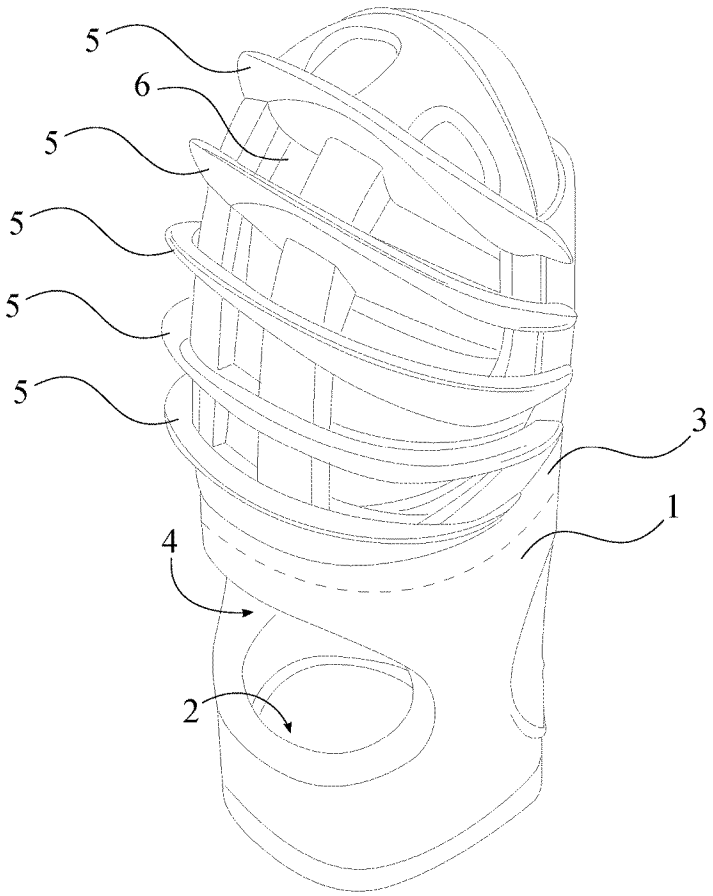
FIG. 1 is a bottom perspective view of the present invention.

In accordance to FIG. 1, the present invention comprises a digit-mounting tube 1, a digit-receiving opening 2, a distal-closed end 3, and at least one joint-accommodating aperture 4. The digit-mounting tube 1 secures the present invention about a digit, preferably a thumb, of the user's hand. The digit-receiving opening 2 allows the user to insert the digit into the digit-mounting tube 1. The digit-receiving opening 2 traverses into the digit-mounting tube 1 to provide a cavity for the user to fit the digit within. The distal-closed end 3 is perimetrically connected to the digital-mounting tube. The distal-closed end 3 protects the digit by cushioning the digit as the user manually inserts ammunition into a magazine. Additionally, the distal-closed end 3 restricts how much of the digit is able to be positioned within the digit-mounting tube 1. The digit-receiving opening 2 is oppositely positioned to the distal-closed end 3, along the digit-mounting tube 1. Therefore, the digit is inserted through the digit-receiving opening 2, laterally enclosed by the digit-mounting tube 1, and pressed against the distal-closed end 3 when the present invention is positioned about the digit. The at least one joint-accommodating aperture 4 laterally traverses into the digit-mounting tube 1. The at least one joint-accommodating aperture 4 allows the user to flex the digit at a distal joint of the digit.

Figure 2:
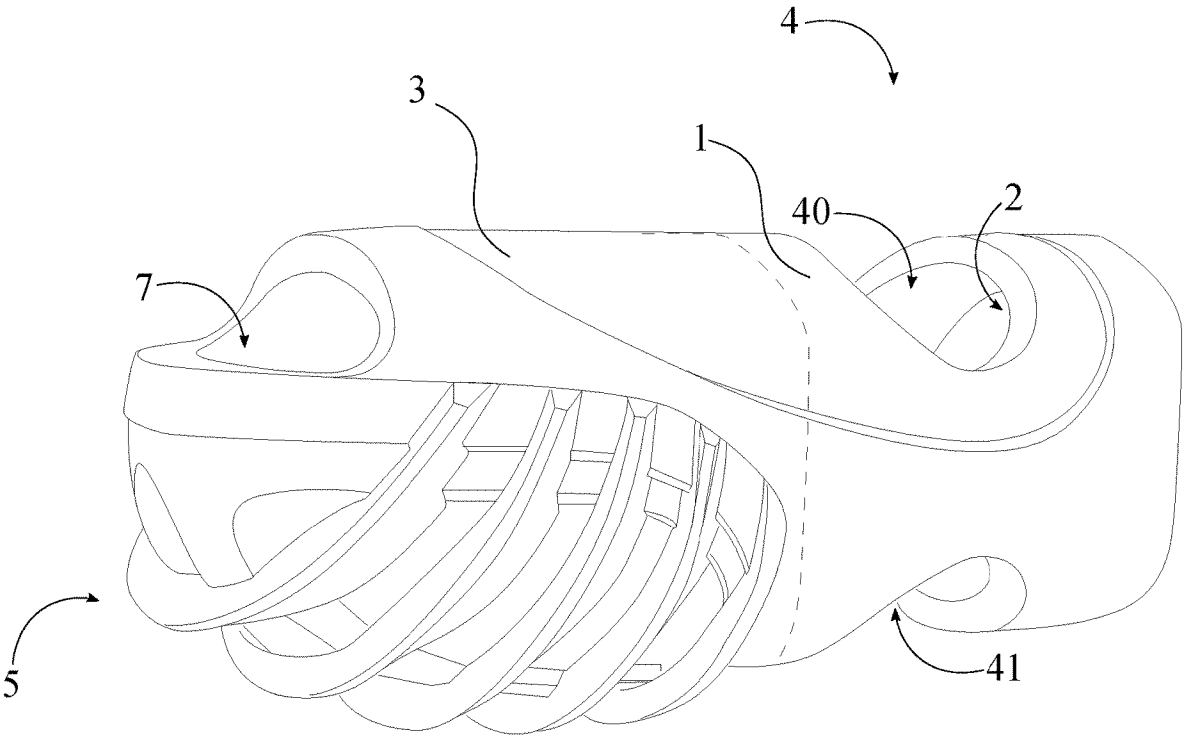
FIG. 2 is a side perspective view of the present invention.
Figure 3:
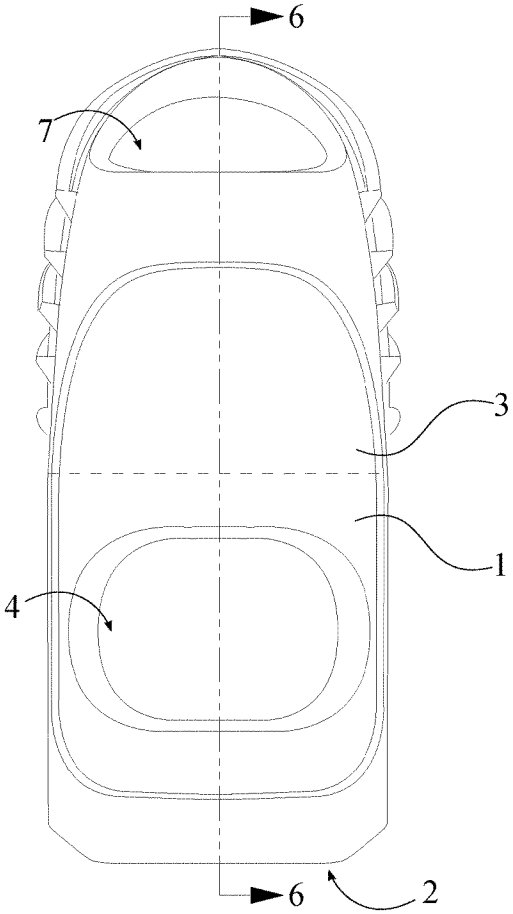
FIG. 3 is a top view of the present invention.
Figure 4:
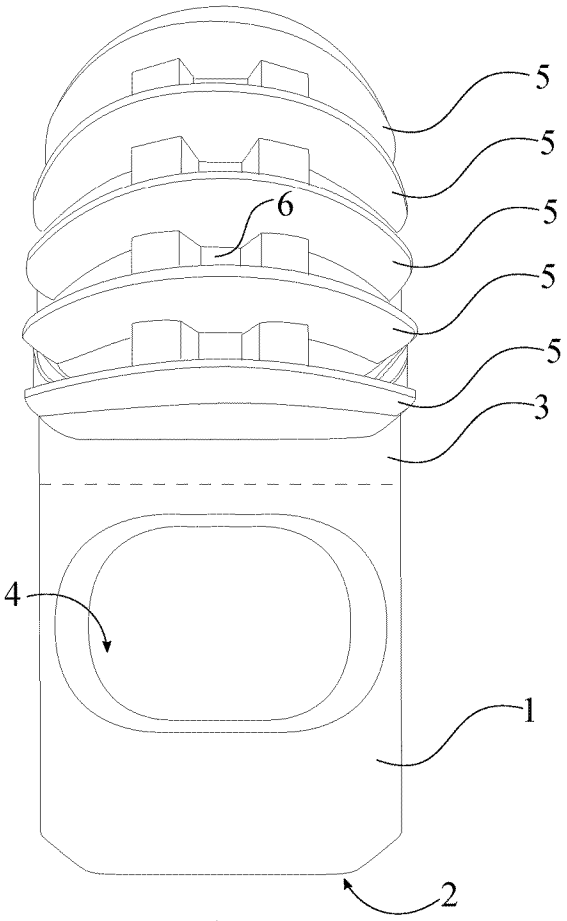
FIG. 4 is a bottom view of the present invention.
Figure 5:
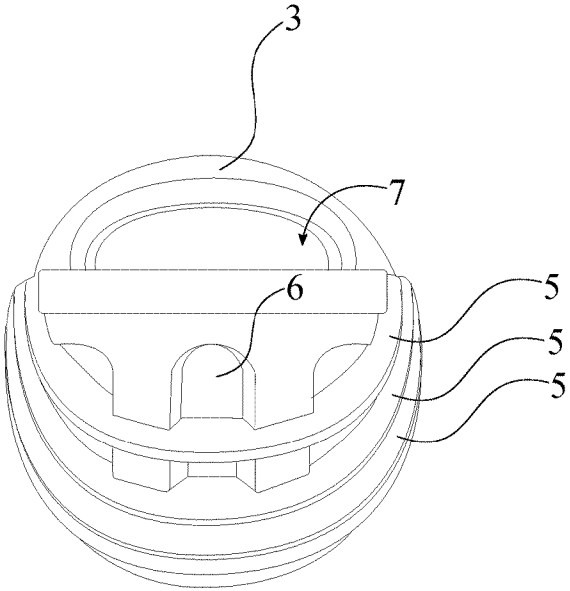
FIG. 5 is a front view of the present invention.
Figure 6:
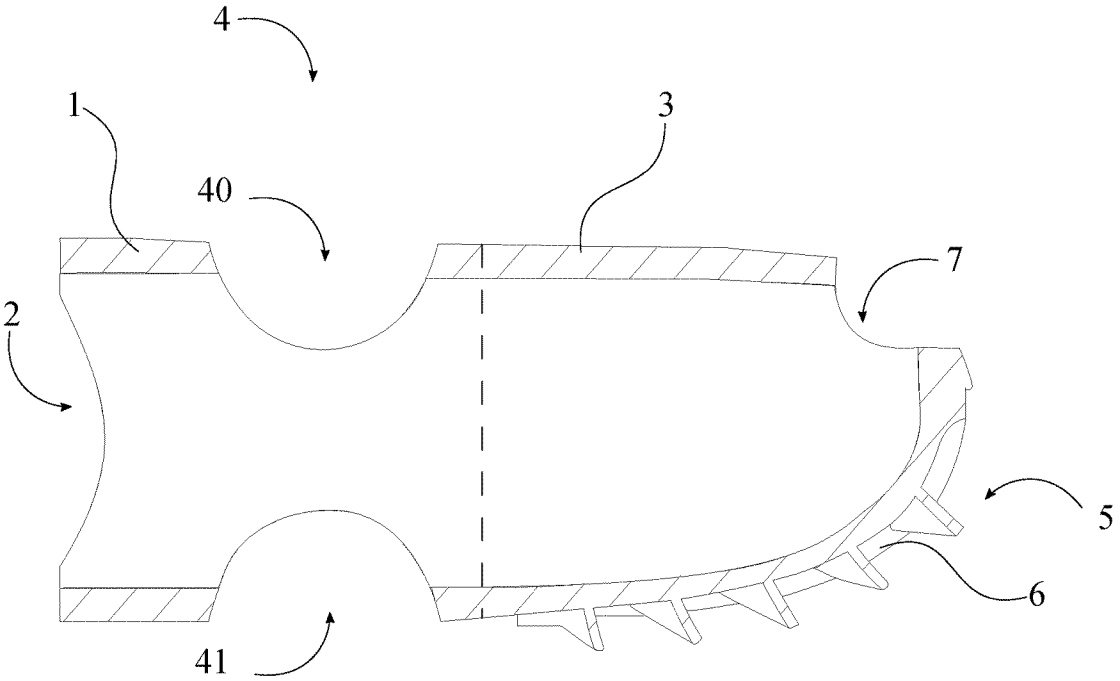
FIG. 6 is a cross-sectional side view of the present invention, along line 6-6 from FIG. 3

In accordance to the preferred embodiment of the present invention, the at least one joint-accommodating aperture 4 is a first joint-accommodating aperture 40 and a second joint-accommodating aperture 41. Shown in FIG. 2 and FIG. 6, the first joint-accommodating aperture 40 is oppositely positioned to the second joint-accommodating aperture 41, about the digit-mounting tube 1. This configuration allows the first joint-accommodating aperture 40 and the second joint-accommodating aperture 41 to be positioned on either side of the distal joint to allow the distal joint to flex, while the present invention is engaged with the digit.

Further in accordance to the preferred embodiment of the present invention, the present invention comprises a plurality of ammunition gripping extrusions 5, detailed in FIG. 1, FIG. 2, and FIG. 4 to FIG. 6. The plurality of ammunition gripping extrusions 5 provides a plurality of surfaces for the ammunition to apply pressure against the ammunition to load the ammunition into the magazine. Each of the plurality of ammunition gripping extrusions 5 is integrated with the distal-closed end 3. Each of the plurality of ammunition gripping extrusions 5 is offset from each other, along the distal-closed end 3. This configuration allows the user to press a gripping extrusion from the plurality of ammunition gripping extrusions 5 against a rear of the ammunition casing. Thus, each of the plurality of ammunition gripping extrusions 5 allows additional pressure onto the ammunition as the user inserts the ammunition into the magazine.

In an alternate embodiment of the present invention, the present invention further comprises an ammunition channel 6, exemplified in FIG. 1 and FIG. 4 to FIG. 6. The ammunition channel 6 contours to the shape for an ammunition casing, in order to prevent the ammunition from sliding tangentially to the digit of the user. The ammunition channel 6 is integrated with the distal-closed end 3. The ammunition channel 6 is positioned along the distal-closed end 3. This configuration prevents the ammunition from sliding tangentially about the distal-closed end 3 as the user is inserting the ammunition into the magazine.

In some embodiments of the present invention wherein the present invention comprises the ammunition channel 6 and the plurality of ammunition gripping extrusions 5, the ammunition channel 6 is perpendicularly oriented to the plurality of ammunition gripping extrusions 5. This configuration prevents the ammunition from sliding tangentially or laterally along the distal-closed end 3 as the user applies pressure onto the ammunition to insert the ammunition into the magazine.

In further accordance to the preferred embodiment of the present invention, the present invention comprises a nail-receiving aperture 7, detailed in FIG. 2, FIG. 3, FIG. 5 and FIG. 6. The nail-receiving aperture 7 allows the user to insert a nail of the digit through the present invention. The nail-receiving aperture 7 traverses through the distal-closed end 3, opposite to the digit-mounting tube 1. The nail-receiving aperture 7 is oppositely positioned to the plurality of gripping extrusions, about the distal-closed end 3. The nail-receiving aperture 7 reduces the pressure onto the nail as the user applies pressure to the distal-closed end 3 to insert the ammunition into a magazine.

Although the invention has been explained in relation to its preferred embodiment, it is to be understood that many other possible modifications and variations can be made without departing from the spirit and scope of the invention as hereinafter claimed.

What is claimed is:

1. A thumb mounted ammunition loader comprising:

a digit-mounting tube;

a digit-receiving opening;

a distal-closed end;

at least one joint-accommodating aperture;

a plurality of ammunition gripping extrusions;

an ammunition channel;

the digit-receiving opening longitudinally traversing into the digit-mounting tube;

the distal-closed end being perimetrically connected to the digit-mounting tube without being pivotally connected to the digit-mounting tube;

the digit-receiving opening being oppositely positioned to the distal-closed end, along the digit-mounting tube;

the at least one joint-accommodating aperture laterally traversing into the digit-mounting tube;

each of the plurality of ammunition gripping extrusions being integrated with the distal-closed end;

each of the plurality of ammunition gripping extrusions being laterally extended along the distal-closed end;

the plurality of ammunition gripping extrusions being offset from each other, along the distal-closed end;

the ammunition channel being integrated with the distal-closed end;

the ammunition channel being positioned and being longitudinally extended along the distal-closed end; and the ammunition channel being perpendicularly oriented to each of the plurality of ammunition gripping extrusions.

2. The thumb mounted ammunition loader, as claimed in claim 1, comprising:

the at least one joint-accommodating aperture comprising a first joint-accommodating aperture and a second joint-accommodating aperture; and the first joint-accommodating aperture being oppositely positioned to the second joint-accommodating aperture, about the digit-mounting tube.

3. The thumb mounted ammunition loader, as claimed in claim 1, comprising:

a nail-receiving aperture; and the nail-receiving aperture longitudinally traversing through the distal-closed end, opposite to the digit-mounting tube.

4. The thumb mounted ammunition loader, as claimed in claim 3, comprising:

the nail-receiving aperture being oppositely positioned to the plurality of ammunition gripping extrusions, about the distal-closed end.

* * * * *